United States Patent [19]

Pringle

[11] Patent Number: 4,716,968

[45] Date of Patent: Jan. 5, 1988

[54] DOUBLE SEATED WELL VALVE

[75] Inventor: Ronald E. Pringle, Houston, Tex.

[73] Assignee: Camco, Incorporated, Houston, Tex.

[21] Appl. No.: 2,350

[22] Filed: Jan. 12, 1987

[51] Int. Cl.[4] ..... E21B 34/10

[52] U.S. Cl. ..... 166/319; 166/332

[58] Field of Search ..... 166/332, 319

[56] References Cited

U.S. PATENT DOCUMENTS

| | | | |
|---|---|---|---|
| 4,527,630 | 7/1985 | Pringle | 166/332 X |
| 4,597,445 | 7/1986 | Knox | 166/319 |
| 4,605,070 | 8/1986 | Morris | 166/332 X |
| 4,655,288 | 4/1987 | Burris et al. | 166/332 X |

*Primary Examiner*—Stephen J. Novosad

*Attorney, Agent, or Firm*—Fulbright & Jaworski

[57] ABSTRACT

A double seated well circulating valve for use in a well conduit having a tubular housing with a vertically extending bore therethrough and a port providing communication between the inside and outside of the housing. A first valve seat is horizontally positioned in the bore below the port and a second valve seat is in communication with the port. A valve closure member is movable between the first and second valve seats for alternately closing and opening fluid flow through the bore and through the port. A flow tube telescopically moves in the housing for controlling movement of the valve closure member. A piston and cylinder assembly controls the flow tube and biasing means acts to move the flow tube upwardly.

8 Claims, 8 Drawing Figures

Fig. 1C
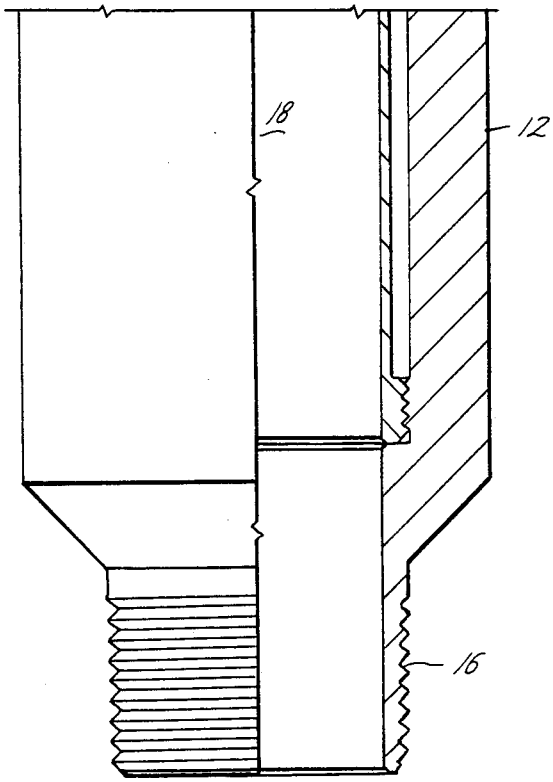
Fig. 3
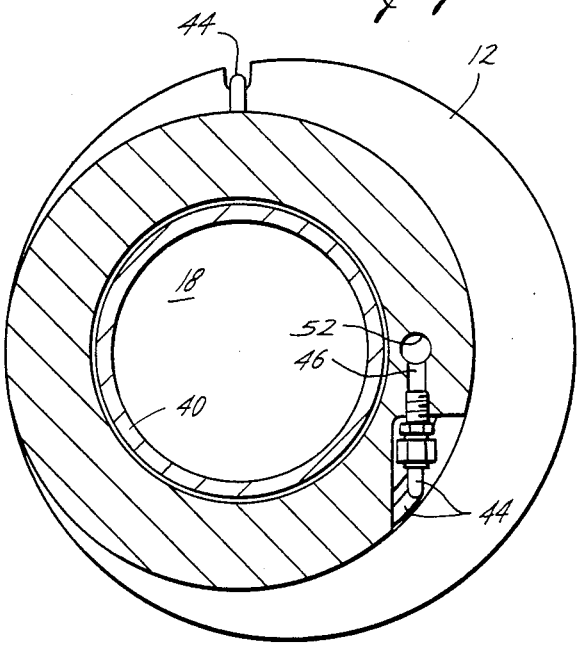
Fig. 2
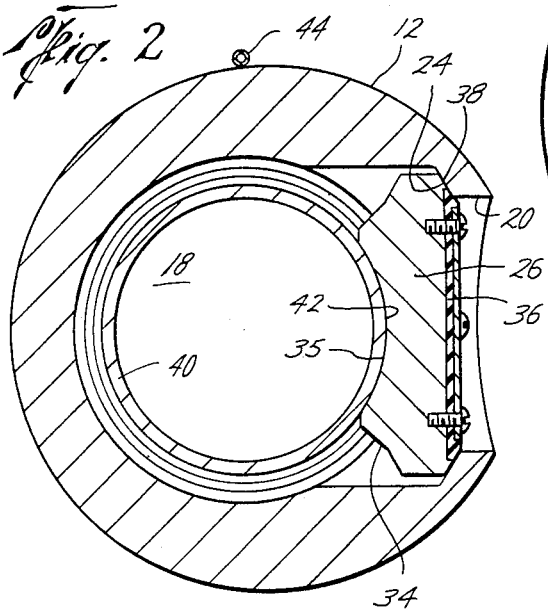
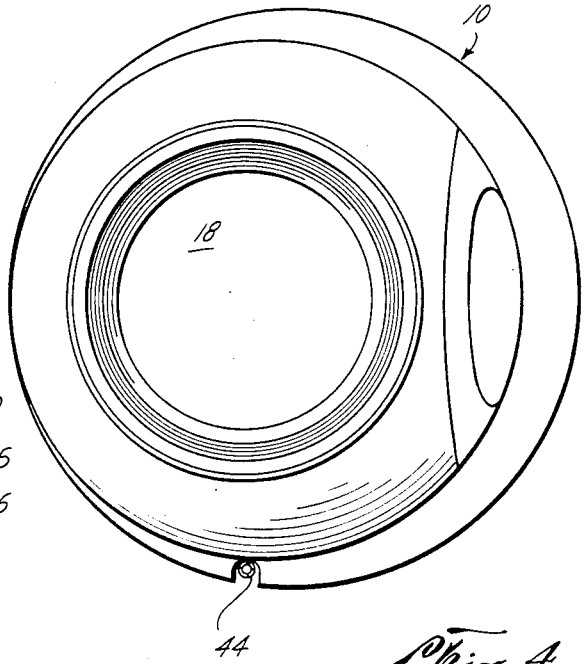
Fig. 4

DOUBLE SEATED WELL VALVE

BACKGROUND OF THE INVENTION

Circulation of various fluids in oil and gas wells by various methods is generally dictated by different well conditions. Well circulation is the displacement of fluid from the annulus between the casing and the tubing to the tubing or vice versa for various reasons for displacing the tubing or annulus fluid to increase or lighten the weight of the fluid, performing well treatment, or killing a well by circulation. If a killing mode is desired, communication is provided to expose the well formation to a heavy fluid. For other operations, it is desired to isolate the producing formation from well fluids to prevent formation damage.

Generally, circulation of well fluids is achieved by opening a valve in a sidepocket mandrel or shifting a sliding sleeve valve. These devices have limitations such as a small flow area in the sidepocket of a well mandrel and the short life of the seals on the sliding sleeve type valve. In any event, the prior art devices require a downhole trip to set a plug below the devices in the tubing string when it is desired to prevent completion fluid from entering the formation. This can be difficult and expensive. The present invention is directed to a subsurface well valve such as a circulation valve having a double seat for preventing formation damage and loss of completion fluid to the formation but allowing circulation without the disadvantages of the prior art devices. The present valve provides the advantages of a full flow area substantially equivalent to the flow area in the well conduit or tubing. In one embodiment, a conventional ball type valve may be provided and in another embodiment a flapper valve may be provided which eliminates seals sliding across ports which result in seal damage, but still provides a metal and resilient seat combination on both valve seats.

SUMMARY

The present invention is directed to a subsurface double seat well valve for use in a well conduit for controlling fluid flow through the conduit and between the inside and outside of the conduit. The valve includes a tubular housing adapted to be connected in the well conduit in which the housing has a bore therethrough. A first valve seat is positioned in the bore and a second valve seat in the housing between the inside and outside of the housing. A valve closure member is positioned in the housing and is movable between the first and second valve seats for alternately closing and opening fluid flow through the bore and between the inside and outside of the housing. A flow tube is telescopically movable in the housing for controlling the movement of the valve closure member and a piston and cylinder assembly is positioned in the housing and engages and controls the movement of the flow tube. One side of the assembly is adapted to be in communication with the fluid control passageway to the well surface. Biasing means in the housing acts in a direction to move the valve closure member onto the second valve seat.

Still a further object of the present invention is wherein the valve closure member is a flapper valve and coacting tapered surfaces are provided on the valve closure member and the flow tube for locking the flapper on the second seat.

A further object is the provision of the coacting tapered surfaces having an area for withstanding the pressure forces at the port.

Yet a still further object of the present invention is the provision of metal and resilient sealing surfaces between the valve closure member and each of the valve seats.

Still a further object of the present invention is the provision of a double seated well circulating valve for use in a well conduit for controlling fluid flow through the conduit and between the inside and outside of the conduit. A tubular housing is adapted to be connected in a well conduit and the housing has a vertically extending bore therethrough and has a port providing communication between the inside and outside of the housing. A first valve seat is horizontally positioned in the bore below the port and a second valve seat is vertically positioned in the housing in communication with the port. A valve closure member pivots in the housing and is movable between the first and second valve seats for alternately closing and opening fluid flow through the bore and through the port. A flow tube telescopically moves in the housing for controlling the movement of the valve closure member. The flow tube is movable upwardly through the first valve seat and adjacent the second valve seat for moving the closure member against the second valve seat and is movable below the first valve seat for allowing the closure member to seat on the first valve seat. A piston and cylinder assembly is positioned in the housing and engages the flow tube and one side of the assembly is adapted to be communication with a fluid control passageway to the well surface. Biasing means in the housing acts to move the flow tube upwardly and moves the valve closure member onto the second seat while opening flow through the first seat.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIGS. 1A, 1B, and 1C are continuations of each other and are an elevational view, in quarter section, of one embodiment of the valve of the present invention, shown with the bore open and a side port closed, FIG. 2 is a cross-sectional view taken along the line 2—2 of FIG. 1A, FIG. 3 is a cross-sectional view taken along the line 3—3 of FIG. 1A, FIG. 4 is a cross-sectional view taken along the line 4—4 of FIG. 1A.

DESCRIPTION OF THE PREFERRED EMBODIMENT

Figure 1A:
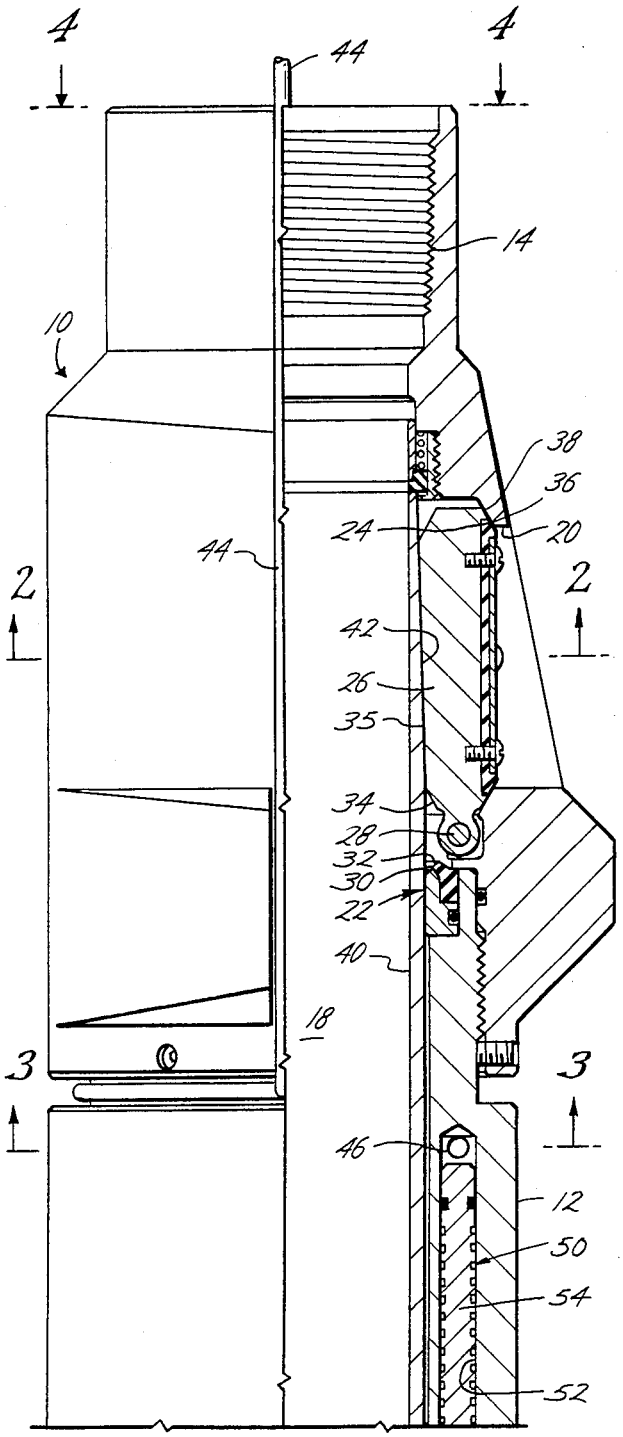
Figure 1B:
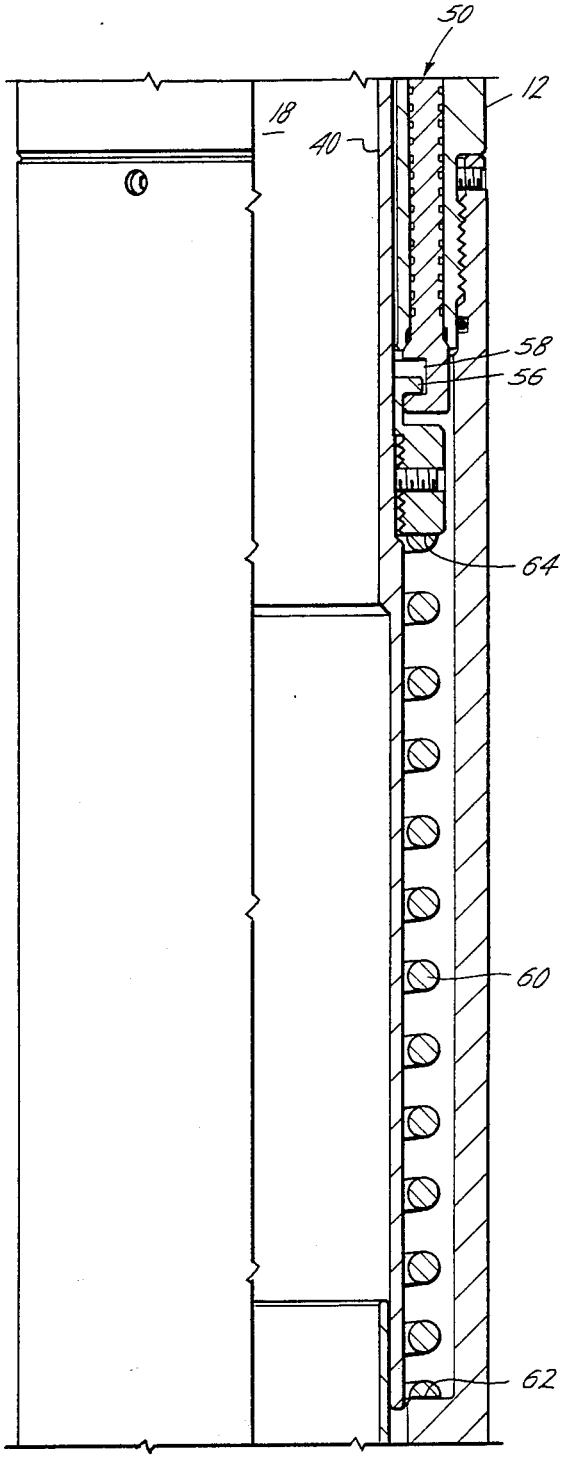

Referring now to the drawings, and particularly to FIGS. 1A through 1C, the double seated valve of the present invention is generally indicated by the reference numeral 10 and includes a housing 12 having connections at each end such as threads 14 and 16 for connection in a well conduit such as a well tubing to form a part thereof. The housing 12 includes a vertically extending bore 18 therethrough to provide communication between the producing formation of an oil and/or gas well to the well surface. The housing 12 also includes a side port 20 providing communication beween the inside or bore 18 of the housing 12 and the outside of the housing 12 such as the annulus between the housing 12 and well casing (not shown)

A first valve seat generally indicated by the reference numeral 22 is horizontally positioned in and surrounds the bore 18 below the port 20. A second valve seat 24 is vertically positioned in the housing about the port 20.

A valve closure member such as flapper valve 26 is positioned in the housing and is preferable pivotally connected to the housing 12 by a pivot pin 28. The flapper valve 26 is movable between the first and second valve seats 22 and 24. The flapper valve 26 alternately closes and opens fluid flow through the bore 18 and through the port 20. As best seen in FIG. 1A and FIG. 2, the valve closure member 26 is seated on the valve seat 24 closing fluid flow through the port 20, but allows fluid flow through the bore 18.

Preferably both metal and resilient surfaces are provided between the flapper valve closure member 26 and each of the valve seats 22 and 24. Thus, the first valve seat 22 includes a metal seat 30 and a resilient seat 32, both of which are engaged by the polished metal sealing surface 34 on the flapper valve 26. Similarly, a resilient seal 36 and a metal seal 38 on the opposite side of the flapper valve 26 will engage the metal seat on the second valve seat 24.

A tubular member or flow tube 40 is movable upwardly through the first valve seat 22 and downwardly below the first valve seat 22. When the flow tube 40 is moved to an upward position, the tube 40 pushes the flapper 26 away from the first valve seat 22 and onto the second valve seat 24 closing the port 20 and opening the bore 18. It is to be noted that preferably the upper end of the flow tube 40 and a surface 35 of the flapper 26 have coacting tapered surfaces for mechanically forcing and locking the flapper 26 onto the seat 24 when the flow tube 40 is in the upward position.

It is also to be noted that the area of the port 20 can be a large area port having a full flow area equivalent to the flow area of the bore 18. As the differential pressure from the outside of the housing 12 to the inside bore 18 of the housing 12 may be quite large due to the large port size, it is desirable that this large force be distributed over a large surface area of the flow tube 40 to prevent collapse of the flow tube 40. Therefore, it is desirable that the contact area between the coacting tapered surfaces 42 and 35 be sufficient to hold the flapper 26 under maximum differential pressure without collapsing the flow tube 40.

The valve 10 is controlled by the application or removal of a pressurized fluid, such as hydraulic fluid, through a control line or passageway 44 which extends to the well surface to supply a pressurized hydraulic fluid through a port 46 to a piston and cylinder assembly generally indicated by the reference numeral 50. The assembly 50 includes a cylinder 52 and a piston 54. One of the piston 54 and cylinder 52 engages the flow tube 40 such as the piston 54 by a tongue and groove connection 56 and 58 for moving the flow tube 40 downwardly upon the application of pressurized hydraulic fluid through the line 44.

Therefore, the application of a pressurized hydraulic fluid to the piston and cylinder assembly 50 moves the flow tube downwardly below the first valve seat 22 allowing the flapper valve 26 to pivot about the pin 28, moving away from the second valve seat 24 and onto the first valve seat 22 by the action of differential pressure beween the port 20 and the bore 18.

Biasing means which may include a spring 60 acting between a first shoulder 62 on the housing 12 and a shoulder 64 on the flow tube 40, and also well pressure in the bore 18 acting around the flow tube 40 and against the bottom of the piston and cylinder assembly 50, acts in a direction to move the flow tube 40 upwardly through the first valve seat 22 and moves the flapper valve 26 onto the second valve seat 24.

Application of hydraulic pressure to the line 44 to the piston and cylinder assembly 50 overcomes the biasing means such as the spring 60 and/or biasing fluid and moves the flapper 26 onto the first valve seat 22 thereby allowing various types of well circulating fluid to move between the bore 18 above the first valve seat 22 and the annulus outside of the valve 10 through the port 20. When the flapper element 26 is seated on the first seat 22 circulating fluid is not lost to a well formation below the valve seat 22 nor is any damaging circulating fluids pumped into a well formation. In order to move the flapper valve 26 from the first valve seat 22 to the second valve seat 24, the hydraulic pressure from the well surface through the line 44 is reduced. In the event that the well pressure in the bore 18 below the flapper 26 and the force of the biasing spring 60 are not sufficient to move the flow tube 40 upwardly, because of the hydrostatic head pressure in the bore 18 above the flapper 26, a lightweight fluid is circulated through the port 20 above the valve seat 22 between the bore 18 and the annulus to reduce the hydrostatic head and allow the biasing forces to move the flow tube upwardly. Upward movement of the flow tube 40 will move the flapper valve 26 from the first seat 22 and onto the second seat 24 locking it in place.

Figure 5:
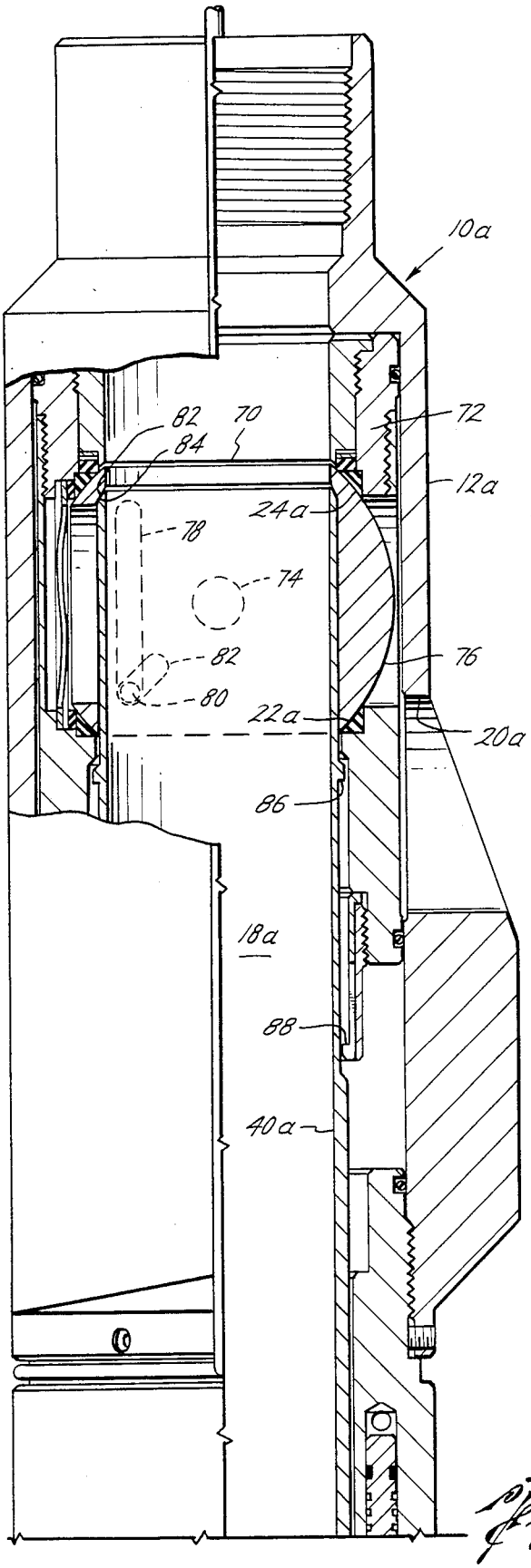
FIG. 5 is a fragmentary cross-sectional view of another embodiment of the present invention shown in the well production position.
Figure 6:
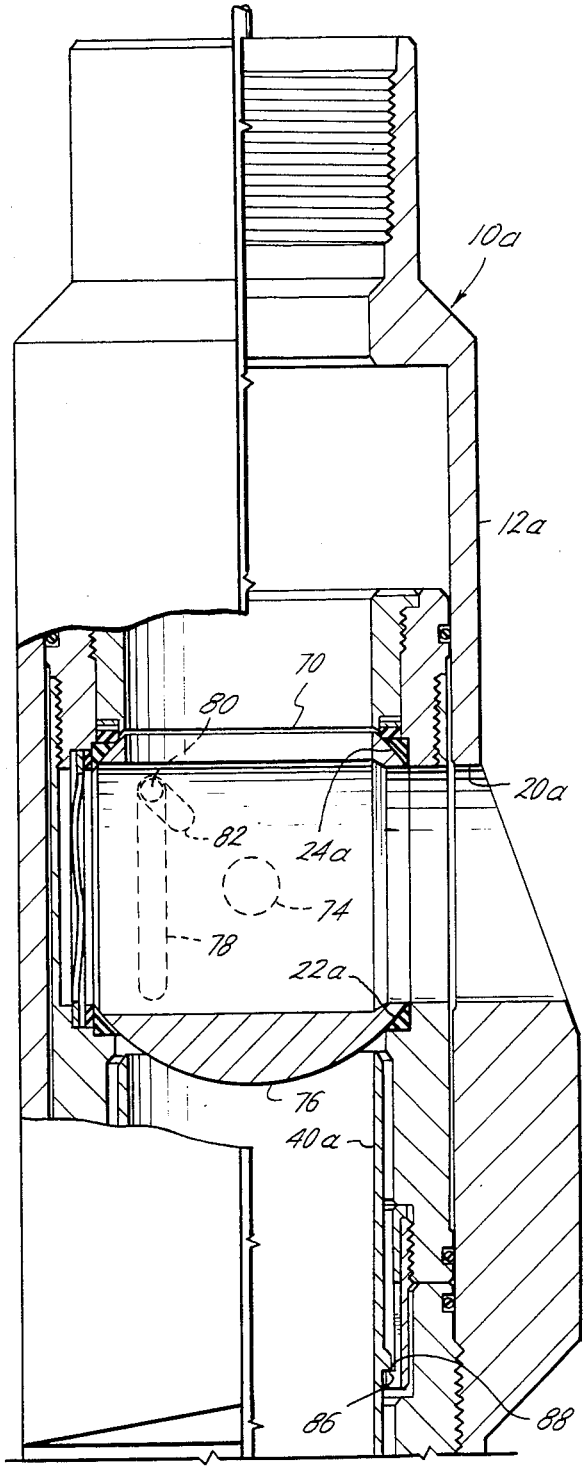
FIG. 6 is a fragmentary cross-sectional view of the embodiment of FIG. 5 with the side port open and the main bore closed.

Other and further embodiments of the present invention may be provided, one of which is shown in FIGS. 5 and 6 utilizing a ball type valve instead of a flapper valve, wherein like parts to those shown in FIGS. 1–4 are similarly numbered with the addition of the suffix "a". Thus, a housing **12*a* includes a vertically extending bore 18*a* and a side port 20*a* for providing communication between the bore 18*a* and the outside of the housing 12*a*. A first valve seat 22*a* is horizontally positioned in and surrounds the bore 18*a*. A second valve seat 24*a* is vertically positioned in the housing and is in communication with the port 20*a***.

A ball type valve element generally indicated by the reference numeral 70 is provided. As shown, the seats **22*a*, 24*a* and ball valve 70 are supported from a support 72 which is telescopically movable inside of the housing 12*a* although, of course, the seats and valve element may be connected to the housing 12*a* as in other types of ball valves. The ball valve 70 may be mounted on trunions 74 from the support 72 and includes an arcuate valve element 76 for pivoting about the trunions 74 for seating on the seat 24*a* or the seat 22*a*. As is conventional, the support 72 includes a slot 78 in which is connected a pin 80 and the pin is also connected in an elongate groove 82 in the valve element 70. The pin 80 is attached to the housing 12*a* and extends radially inwardly therefrom through the slot 78 and into the groove 82. Thus, as the support 72 is moved from the upward position shown in FIG. 5 to a lowered position as shown in FIG. 6, the valve element 70 is pivoted to move the arcuate valve element 76 from the seat 24*a*** thereby opening the port 20a to a position on the first valve seat 22a blocking flow through the bore 18a. The flow tube 40a in the bore production position shown in FIG. 5 extends upwardly through the first valve seat 22a and its upper end 82 seats against the valve element 70 at 84. The flow tube 40a includes a shoulder 86 which when moved down by hydraulic control fluid acting upon the piston and cylinder assembly engages a shoulder 88 on the movable support 72. This causes the support 72 to move downwardly, as best seen in FIG. 6, to bring the second valve seat 24a into alignment with the port 20a and pivots the valve element 76 away from the second valve seat 24a and onto the first valve seat 22a. This allows fluid flow through the port 20a, but closes fluid flow through the bore 18a.

The valve 10a is controlled by the application or removal of a hydraulic fluid acting upon a piston and cylinder assembly for moving the flow tube 40a downwardly and by upward movement of the flow tube 40a by a biasing spring as shown and described in connection with the embodiment shown in FIGS. 1–4.

The present invention thereby provides a double seated well circulating valve having a flow area between the inside and outside of the valve essentially equivalent to the area of the bore, and avoids the necessity of setting a plug below the valve prior to circulating fluid between the well annulus and the tubing bore.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A subsurface double seated well valve for use in a well conduit for controlling fluid flow through the conduit and between the inside and outside of the conduit comprising, a tubular housing adapted to be connected in a well conduit, said housing having a bore therethrough, a first valve seat in the bore and a second valve seat in the housing in communication between the inside and the outside of the housing, a valve closure member in the housing movable between and into contact with the first and second valve seats for alternately closing and opening fluid flow through the bore and between the inside and outside of the housing, a flow tube telescopically movable in the housing for controlling the movement of the valve closure member, a piston and cylinder assembly positioned in the housing and engaging the flow tube, one side of the assembly adapted to be in communication with a fluid control passageway to the well surface, and biasing means in the housing acting in a direction to move the valve closure member onto the second valve seat.

2. The apparatus of claim 1 wherein the valve closure member is a flapper valve and including coacting tapered surfaces on the valve closure member and the flow tube for moving the flapper on the second seat.

3. The apparatus of claim 1 including, metal and resilient sealing surfaces between the valve closure member and each of the valve seats.

4. The apparatus of claim 1 wherein the valve closure member is a ball type valve movable between the first and the second valve seats.

5. A double seated well circulating valve for use in a well conduit for controlling fluid flow through the conduit and between the inside and outside of the conduit comprising, a tubular housing adapted to be connected in a well conduit, said housing having a vertically extending bore therethrough, and said housing having a port providing communication between the inside and the outside of the housing, a first valve seat horizontally positioned in the bore below the port and a second valve seat vertically positioned in the housing in communication with the port, a valve closure member pivoting in the housing and movable between the first and second valve seats for alternately closing fluid flow through the bore and through the port, a flow tube telescopically movable in the housing for controlling the movement of the valve closure member, said flow tube movable upwardly through the first valve seat and adjacent the second valve seat for moving the closure member against the second seat and movable below the first valve seat for allowing the closure member to seat on the first valve seat, a piston and cylinder assembly positioned in the housing and engaging the flow tube on one side of the assembly, and adapted to be in communication with a fluid control passageway to the well surface, and biasing means in the housing acting to move the flow tube upwardly and move the valve closure member onto the second seat.

6. The apparatus of claim 5 wherein the valve closure member is a flapper valve and including coacting tapered surfaces on the valve closure member and the flow tube for moving and locking the flapper on the second seat.

7. The apparatus of claim 5 including, metal and resilient sealing surfaces between the valve closure member and each of the valve seats.

8. The apparatus of claim 6 wherein the valve closure member is a ball type valve pivoting between the first and second valve seats.

* * * * *